US005572874A

United States Patent [19]

Rathbone

[11] Patent Number: 5,572,874

[45] Date of Patent: Nov. 12, 1996

[54] AIR SEPARATION

[75] Inventor: Thomas Rathbone, Farnham, England

[73] Assignee: The BOC Group, plc, Windlesham, England

[21] Appl. No.: 488,920

[22] Filed: Jun. 9, 1995

[30] Foreign Application Priority Data

Jun. 17, 1994 [GB] United Kingdom ..... 9412182

[51] Int. Cl.[6] ..... F25J 3/04

[52] U.S. Cl. ..... 62/645; 62/654; 62/924

[58] Field of Search ..... 62/22, 24, 38, 62/41

[56] References Cited

U.S. PATENT DOCUMENTS

| | | | |
|---|---|---|---|
| 4,783,208 | 11/1988 | Rathbone | 62/26 |
| 5,049,174 | 9/1991 | Thorogood et al. | 62/24 |
| 5,100,447 | 3/1992 | Krishnamurthy et al. | 62/22 |
| 5,305,611 | 4/1994 | Howard | 62/41 |
| 5,396,772 | 3/1995 | McKeigue et al. | 62/39 |

FOREIGN PATENT DOCUMENTS

| | | |
|---|---|---|
| 0 594 214 | 4/1994 | European Pat. Off. . |
| 0 377 117 | 7/1990 | Germany . |

*Primary Examiner*—Ronald C. Capossela
*Attorney, Agent, or Firm*—David M. Rosenblum; Larry R. Cassett

[57] ABSTRACT

Air is introduced through an inlet into a higher pressure rectification column. A stream of oxygen-enriched liquid is withdrawn through an outlet from the higher pressure rectification column. A part of this stream is introduced into a low pressure rectification column through an inlet. The stream is separated in the column low pressure rectification into oxygen and nitrogen. In addition, an argon-enriched vapor stream is withdrawn from the low pressure rectification column through an outlet, and is at least partially condensed in a reboiler-condenser which reboils oxygen separated in an argon column. One part of the resulting at least partially condensed argon-enriched oxygen stream is reduced in pressure by passage through a valve and is introduced through an inlet into an intermediate mass exchange region of the argon column in which it is separated into argon and oxygen. Another part of the at least partially condensed argon-enriched oxygen stream is returned by a pump to the low pressure rectification column.

20 Claims, 3 Drawing Sheets

AIR SEPARATION

BACKGROUND OF THE INVENTION

This invention relates to a method and apparatus for separating argon and oxygen from oxygen-enriched air.

The most important method commercially for separating air is by rectification. In typical air rectification processes, there are performed the steps of compressing a stream of air, purifying the resulting stream of compressed air by removing water vapour and carbon dioxide from it, and precooling the stream of compressed air by heat exchange with returning product streams to a temperature suitable for its rectification. The rectification is performed in a so-called "double rectification column" comprising a higher pressure and a lower pressure column, i.e. one of two columns operates at a higher pressure than the other. Most of the incoming air is introduced into the higher pressure column and is separated into oxygen-enriched liquid air and a nitrogen vapour. The nitrogen vapour is condensed. Part of the condensate is used as liquid reflux in the higher pressure column. Oxygen-enriched liquid is withdrawn from the bottom of the higher pressure column and is used to form a feed stream to the lower pressure column. Typically the oxygen-enriched liquid stream is sub-cooled and introduced into an intermediate region of the lower pressure column through a throttling or pressure reduction valve. The oxygen-enriched liquid air is separated into substantially pure oxygen and nitrogen in the lower pressure column. Gaseous oxygen and nitrogen products are taken from the lower pressure column and typically form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling (i.e. pressure reducing) valve. An upward flow of vapour through the lower pressure column from its bottom is created by reboiling liquid oxygen. The reboiling is carried out by heat exchanging the liquid oxygen at the bottom of the lower pressure column with nitrogen from the higher pressure column. As a result, the nitrogen vapour is condensed.

A local maximum concentration of argon is created at an intermediate level of the lower pressure column beneath that at which the oxygen-enriched liquid air is introduced. If it is desired to produce an argon product, a stream of argon-enriched oxygen vapour is taken from a vicinity of the lower pressure column where the argon concentration is typically in the range of 5 to 15% by volume of argon and is introduced into a bottom region of a side column in which an argon product is separated therefrom. Typically, no steps are taken to adjust the pressure of the argon-enriched oxygen vapour stream as it flows from the lower pressure column to the argon column. Reflux for the argon column is provided by a condenser at the head of the column. The condenser is cooled by at least part of the oxygen-enriched liquid air upstream of the introduction of such liquid air into the lower pressure column.

It is well known to use sieve trays in the argon column in order to effect contact between liquid and vapour therein. Since argon and oxygen have similar volatilities, a considerable number of trays are typically used in the argon column. The resulting pressure drop in the argon column has the result that a desirable small temperature difference can be maintained between argon being condensed and the oxygen-enriched liquid used to cool the head condenser.

Since the middle of the 1980's considerable interest has been focused upon using packing instead of trays in order to effect liquid-vapour contact in the columns of an air separation plant. EP-A-0 377 117 confirms that by using a sufficient height of packing in the argon column an essentially oxygen-free argon product can be taken from it. (If distillation trays are used in the argon column, the pressure drop is sufficient for,the condensing temperature of oxygen-free argon to become so low that the head condenser would become inoperable when it is required to introduce the oxygen-enriched fluid from it into the lower pressure column.) However, as a result the temperature difference between the oxygen-enriched liquid and the argon streams in the head condenser becomes undesirably high. EP-B-341 512 discloses controlling the pressure difference in the head condenser by employing a valve to reduce the pressure of the argon-enriched oxygen stream flowing from the lower pressure column to the argon column. EP-A-594 214 discloses a process in which the argon-enriched oxygen is used to reboil the argon column, being condensed thereby. The condensed argon-enriched oxygen stream is introduced into the argon column at an intermediate mass transfer region thereof but liquid is still returned from the bottom of the argon column to the same region of the lower pressure column from which the argon-enriched oxygen is withdrawn.

In all the processes described above, the performance of that part of the separation in which the argon concentration of the oxygen is reduced from 5% by volume to that specified for the oxygen product is performed exclusively in the lower pressure rectification column. It is an aim of the present invention to provide a method and apparatus that enables some of this separation to be performed in the argon column itself and an oxygen product to be withdrawn therefrom. Certain advantages are thereby made possible as will be described below.

SUMMARY OF THE INVENTION

According to the present invention there is provided a method of separating argon and oxygen products from oxygen-enriched air, comprising forming a stream of oxygen-enriched air at a temperature suitable for its separation by rectification, separating the stream into oxygen and nitrogen in a low pressure rectification column, supplying liquid nitrogen reflux to the low pressure rectification column, creating a flow of reboiled oxygen upwardly through the low pressure rectification column, withdrawing an argon-enriched oxygen vapour stream from an intermediate mass transfer region of the low pressure column, at least partially condensing the argon-enriched oxygen vapour stream, reducing the pressure of at least part of the condensed argon-enriched stream, introducing the resulting pressure-reduced stream into an intermediate mass exchange region of an argon column and separating argon-enriched and argon-depleted fluids therefrom, wherein the condensation of the argon-enriched oxygen stream is performed by indirect heat exchange with argon-depleted liquid separated in the argon column, characterized in that another part of the condensed argon-enriched oxygen stream is returned to the low pressure rectification column.

The invention also provides apparatus for separating argon and oxygen products from oxygen-enriched air, comprising means for forming a stream of oxygen-enriched air at a temperature suitable for its separation by rectification, a low pressure rectification column for separating the stream into oxygen and nitrogen, a first condenser-reboiler for supplying liquid nitrogen reflux to the low pressure rectification column, a conduit for the flow of an argon-enriched vapour stream from an intermediate mass transfer region of the low pressure column to an intermediate mass transfer level of an argon column for separating argon-enriched and argon-depleted fluids from the argon-enriched vapour stream, pressure reduction means in the conduit, and a second condenser-reboiler associated with the argon column, wherein the condensing passages of the second condenser-reboiler are in a position in the said conduit upstream of the said pressure reduction means so as to enable at least a part of the argon-enriched vapour stream to be condensed by indirect heat exchange with argon-depleted liquid separated in the argon column, characterized in that downstream of the condensing passages of the second condenser-reboiler, the said conduit communicates with an inlet to the low pressure rectification column.

The method and apparatus according to the invention offer two main advantages. First, the argon-depleted fluid is able to be produced with a minimal content of argon and hence an oxygen product, preferably in liquid state, may be withdrawn from the argon column without having any major adverse effect on the argon yield of the process.. This avoids the need to return the argon-depleted stream to the low pressure rectification column, and thus enables a reduction in the vapour loading on, and hence the diameter of the argon column, to be made in comparison with comparable known processes. Second, by employing the reboiler associated with the argon column to reboil argon-depleted liquid, the reboil rate is improved in the bottom section of the low pressure rectification column. As a result, it is possible to gain power savings in comparison with the operation of conventional air separation processes. (Since the argon-enriched oxygen stream is itself used to heat the reboiler associated with the argon column, there is no requirement for any independent heat pump circuit for this purpose.)

The stream of oxygen-enriched air, preferably in liquid state, is preferably taken from a higher pressure fractionation column in which nitrogen is separated from a stream of compressed air from which water vapour and carbon dioxide have been removed. Typically, air is also supplied to the low pressure rectification column from an expansion turbine. The method and apparatus according to the invention make possible, in comparison with a comparable conventional method, an increase in the proportion of air supplied to the low pressure column relative to the proportion supplied to the higher pressure column, thereby reducing the specific power.

In some examples of the method according to the invention the stream of oxygen-enriched liquid air is not changed in composition intermediate the higher and low pressure columns. In other examples of the method according to the invention, the stream of oxygen-enriched liquid air is further enriched in oxygen upstream of its being introduced into the low pressure column. The further enrichment is preferably performed by passing a stream of oxygen-enriched liquid from the higher pressure column through a pressure reducing device into an intermediate pressure fractionation column operating at a pressure at its top higher than the pressure at the top of the low pressure column but lower than the pressure at the top of the higher pressure column; separating nitrogen from the oxygen-enriched liquid air in the intermediate pressure column; reboiling a part of a bottom liquid fraction formed in the intermediate pressure column to provide a flow of vapour upwardly therethrough; and withdrawing as the further enriched liquid air a stream of said bottom liquid fraction. Nitrogen separated in the intermediate pressure fractionation column may be condensed, and a part of the condensate used to supplement the liquid nitrogen reflux supplied to the lower pressure rectification column. Other methods may alternatively be used to supplement the reflux, for example liquid nitrogen can be added from an independent source. An alternative but less preferred method of forming the further enriched liquid is to flash the stream of oxygen-enriched liquid from the higher pressure column through a pressure reducing valve and to reboil a part of the resulting liquid, a stream of the residual oxygen-enriched liquid air being taken as the further enriched liquid. Typically, a reboiler-condenser employed in this last alternative to reboil the liquid may be located in a phase separator vessel. Alternatively, the reboiler may be located upstream of the phase separator vessel.

Reboiling of the said bottom liquid fraction formed in the intermediate pressure column is preferably performed by indirect heat exchange with nitrogen separated in the higher pressure column. The intermediate pressure column therefore preferably has a third reboiler-condenser associated therewith whose condensing passages communicate with the top of the higher pressure column so as to enable nitrogen to flow through the condensing passages and be condensed. Nitrogen from the higher pressure column is preferably employed in the first condenser-reboiler to reboil the low pressure column.

Those examples of the method according to the invention in which oxygen-enriched liquid from the higher pressure column is further enriched in oxygen upstream of being introduced into the low pressure rectification column increase the capability for producing liquid nitrogen reflux for the low pressure column and are therefore particularly useful if it is required to produce a liquid nitrogen product, to take a gaseous nitrogen product directly from the higher pressure column, to introduce in liquid state a proportion of the air fed to the higher pressure column (for example if air is used to vaporize a pressurized liquid oxygen product) or to operate the method according to the invention in any other way in which there is a tendency for the column system to be deprived of reflux.

By the term "low pressure rectification column" as used herein is meant a column which operates at a pressure at its top of less than 2 bar. The term "indirect heat exchange" as used herein indicates that there is no physical contact between the streams being heat exchanged.

The argon column is preferably packed. Accordingly, the pressure drop per meter height of the argon column can be kept relatively low so as to enable there to be a substantial pressure drop across the pressure reducing device through which the argon-enriched oxygen stream is passed without requiring there to be a pressure substantially about 1.5 bar at the bottom of the LP column or a pressure below atmospheric pressure at the top of the argon column. A suitable packing is the structured packing sold by Sulzer Brothers Limited under the trademark MELLAPAK. The top of the argon column preferably has associated therewith a condenser which is cooled by at least part of the oxygen-enriched liquid flowing to the low pressure rectification column. Alternatively, the condenser may be cooled by a stream of liquid taken from the lower pressure rectification column.

The purity of the argon product depends on the number of trays or height of packing employed in the argon column. If desired, an essentially oxygen-free product may be produced.

The part of the condensed argon-enriched oxygen stream that is returned to the low pressure rectification column is preferably taken from upstream of the pressure reduction means.

The method and apparatus according to the invention is suitable for producing oxygen product in liquid state or, in gaseous state, or for producing separate liquid and gaseous oxygen products. The gaseous oxygen product may be formed by evaporating liquid oxygen withdrawn from one or both of the low pressure and argon columns. In such examples of the method according to the invention, liquid oxygen may be withdrawn from the low pressure rectification column, reduced in pressure and introduced into a sump forming part of the argon column so as to enable a single stream of liquid oxygen to be withdrawn from the sump of the argon column, raised in pressure and evaporated by indirect heat exchange with incoming air to form a gaseous oxygen product. If up to about 30% of the oxygen product is required in liquid state, such liquid oxygen product is preferably withdrawn entirely from the argon column. If the oxygen product is required entirely in gaseous state, liquid oxygen is preferably pumped from the argon column to the low pressure rectification column and is vaporized therein.

BRIEF DESCRIPTION OF THE DRAWINGS

The method and apparatus according to the invention will now be described by way of example with reference to the accompanying drawings, in which.

The drawings are not to scale.

DETAILED DESCRIPTION

Figure 1:
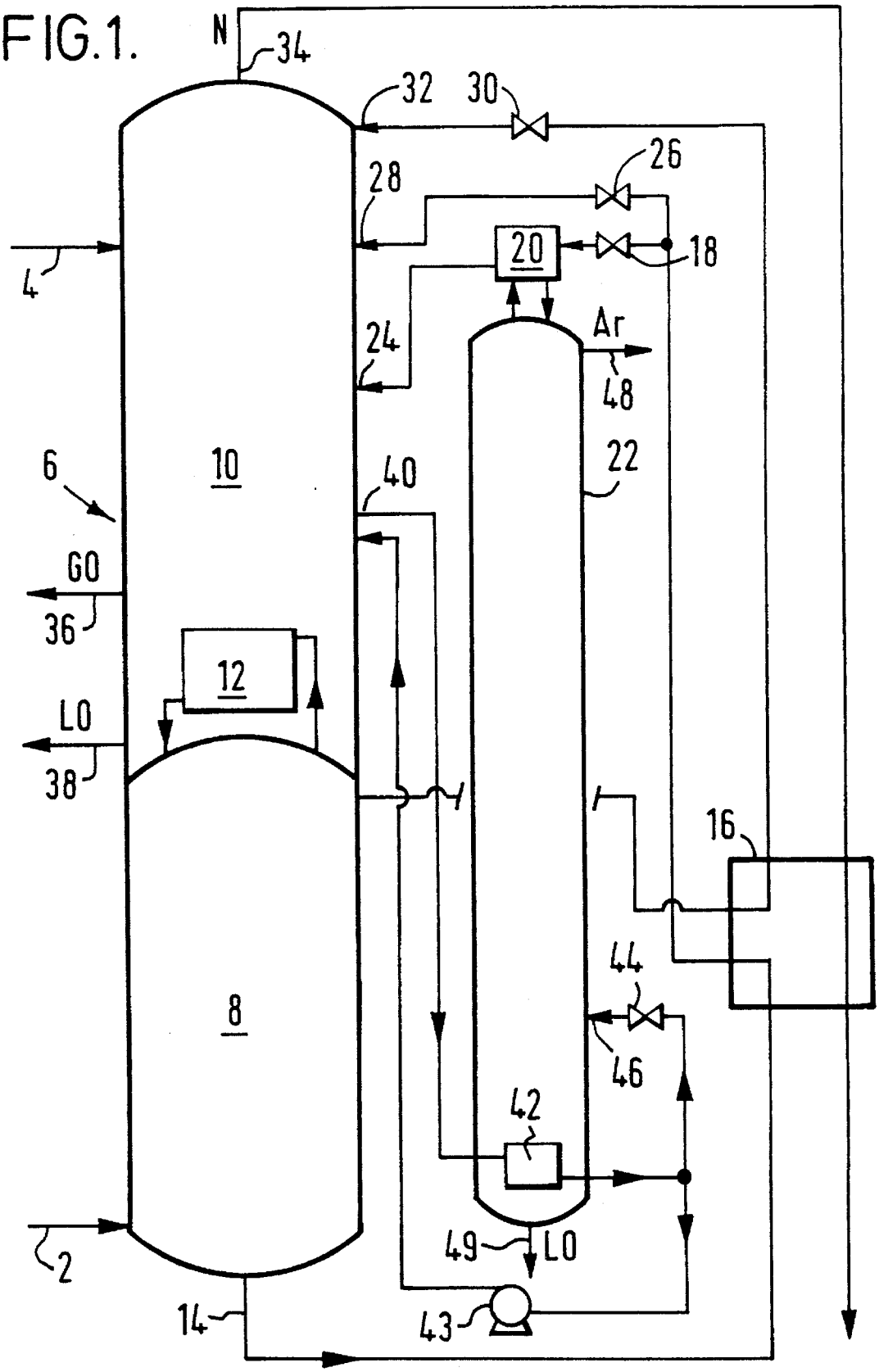
FIG. 1 is a schematic flow diagram with a first apparatus according to the invention.

Referring to FIG. 1, higher pressure and lower pressure air streams are fed to a double rectification column 6 comprising a higher pressure fractionation column 8 and a low pressure rectification column 10. The higher pressure air stream is introduced into the higher pressure column 8 at its dew point temperature, or a temperature a little thereabove, through an inlet 2, which is located beneath all liquid-vapour contact devices (not shown) in the column 8. These liquid-vapour contact devices may take the form of liquid-vapour contact trays or random or structured packing. The low pressure air stream is introduced at its dew point or a temperature a little thereabove into the low pressure rectification column 10 through an inlet 4. The inlet 4 is located at an intermediate mass-transfer level of the column 10.

The higher pressure rectification column 8 is typically operated at a pressure in the order of 6 bar at its bottom and is thermally linked to the low pressure rectification column 10 by a first condenser-reboiler 12. The first condenser-reboiler 12 has condensing passages in which nitrogen separated in the higher pressure column 8 is condensed by indirect heat exchange with liquid oxygen separated in the low pressure column 10, a part of the liquid oxygen thereby being reboiled. A part of the liquid nitrogen condensate formed in the condenser-reboiler 12 is employed as reflux in the higher pressure column 8. Mass exchange takes place as a result of intimate contact between ascending vapour and descending liquid. As a result nitrogen is separated from the incoming air. A stream of liquid is taken from the bottom of the higher pressure column 8 through an outlet 14, and is sub-cooled in a heat exchanger 16. The liquid withdrawn through the outlet 14 is approximately in equilibrium with the air introduced through the inlet 2 and as a result is enriched in oxygen. Downstream of the heat exchanger 16 the stream of sub-cooled oxygen-enriched liquid is divided into two subsidiary streams. One subsidiary stream is passed through a pressure reducing valve 18 and flows through a condenser 20 associated with the top of an argon column 22. This subsidiary stream of oxygen-enriched liquid is vaporized by its passage through the condenser 20. The resulting stream of vapour is introduced into the low pressure rectification column 10 through an inlet 24 at a liquid-vapour contact level of the column 10 beneath that of the inlet 4. A second subsidiary stream of the sub-cooled oxygen-enriched liquid taken from the bottom of the higher pressure rectification column 8 is passed through a pressure reducing valve 26 and is introduced into the low pressure rectification column 10 through an inlet 28 the same level as the inlet 4.

The streams of oxygen enriched fluid introduced into the low pressure rectification column 10 through the inlets 24, 28 and the stream of air introduced through the inlet 4 are separated therein into oxygen and nitrogen products. Reboil for the low pressure rectification column 10 is provided, as previously described, by indirect heat exchange in the first condenser-reboiler 12 between liquid oxygen separated in the low pressure column 10 and nitrogen vapour from the higher pressure column 8, the nitrogen vapour being thereby condensed. Liquid nitrogen reflux for the low pressure rectification column 10 is provided by taking that part of the condensed nitrogen from the condenser-reboiler 12 which is not employed in the high pressure column 8, sub-cooling it in the heat exchanger 16, passing it through a pressure-reducing valve 30 and introducing it into the top of the low pressure rectification column 10 through an inlet 32. In order to effect mass transfer between descending liquid and ascending vapour in the column 10, liquid-vapour contact devices, preferably in the form of structured packing, are provided therein. A nitrogen product is withdrawn from the top of the low pressure rectification column 10 through an outlet 34 and passes through the heat exchanger 16 from its cold end to its warm end. In addition, a part of the oxygen that is reboiled in the first condenser-reboiler 12 is taken as a gaseous oxygen product by way of an outlet 36. In addition, part of the liquid oxygen separated in the low pressure rectification column 10 may be taken as product from the outlet 38.

The principal low boiling constituents of air are oxygen, nitrogen and argon. Although argon constitutes just under 1% by volume of air, a local maximum argon concentration typically in the range of 7 to 15% by volume is created at an intermediate liquid-vapour contact level in the column 10 below that of the inlet 24. An argon-enriched oxygen stream is taken in vapour state through an outlet 40 from a level of the column 10 where the argon concentration is below the maximum but above 5%, preferably above 8%, by volume and is passed through a second reboiler-condenser 42 associated with the bottom of the argon column 22. Passage of the argon-enriched vapour stream in the second condenser-reboiler 42 condenses at least a part and preferably all of the stream. A part of the resulting condensed argon-enriched oxygen stream flows through a pressure reducing valve 44 and is introduced into the argon column through an inlet 46 at an intermediate liquid-vapour contact level thereof. The column 22 is preferably packed and there is thus preferably packing above and below the level of the inlet 46. Accordingly, not only does the argon column 22 produce an argon product ("the argon-enriched fluid"); it also produces an oxygen product (the "argon-depleted fluid"). The oxygen product is withdrawn in liquid state through an outlet 49 and is typically of the same purity as the oxygen products produced in the low pressure rectification column 10, but, if desired, can be produced to a different purity. In order to maintain the purity of the oxygen product produced in the argon column 22, a part of the condensed argon-enriched oxygen stream is returned by a pump 43 to approximately the same mass transfer level of the low pressure column 10 as the outlet 40.

In the argon column 22 ascending vapour and descending liquid are intimately contacted with the result that there is the mass transfer between ascending vapour and descending liquid necessary for the production of the oxygen and argon products. If an impure argon product containing about 2% oxygen is required then there may be an amount of packing above the level of the inlet 46 equivalent to a number of theoretical plates in the range of 40 to 50. If, however, an essentially oxygen-free argon product containing less than, say, 10 parts by volume per million of oxygen is required, a height of packing above the level of the inlet 46 equivalent to a number of theoretical plates in the range of 140 to 180 may typically be used. A liquid argon product is withdrawn from the top of the column 22 through an outlet 48 and may be further purified, for example by having nitrogen removed therefrom in a further rectification column (not shown). If desired, the outlet 48 may be situated below the top of the liquid-vapour contact devices in the column 22 so as to reduce the nitrogen content of the argon product. Further, a gas mixture enriched in nitrogen may be vented as a small bleed stream (not shown) from the top of the column 22.

Figure 2:
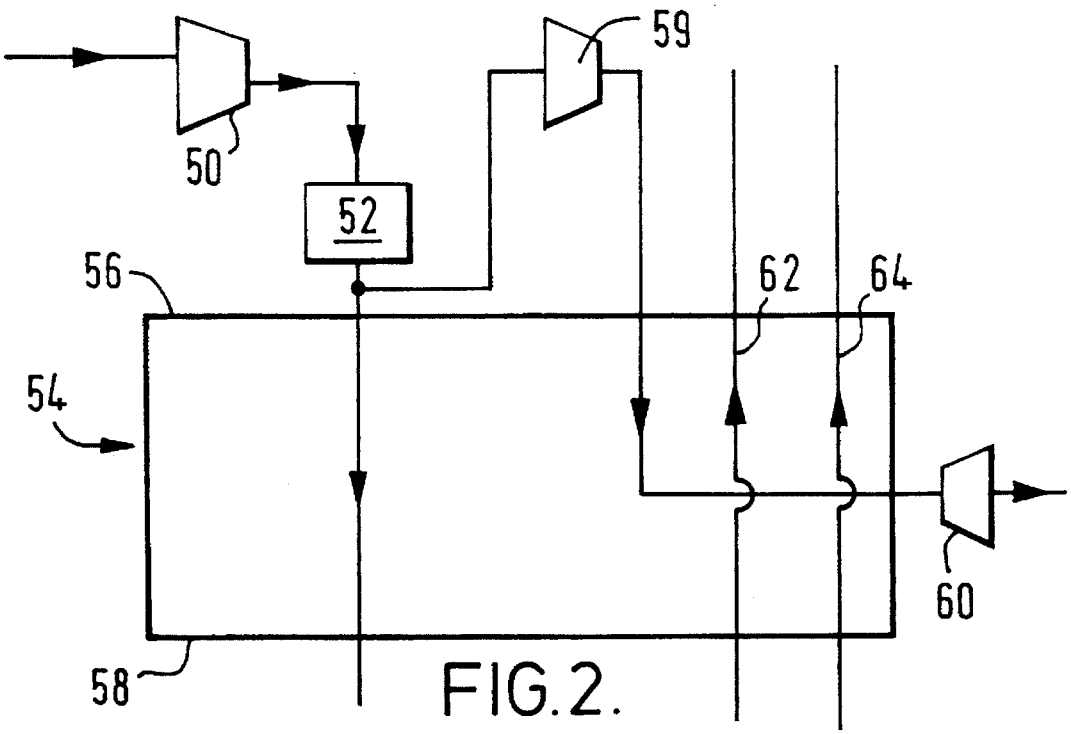
FIG. 2 is a schematic flow diagram of a heat exchanger and associated apparatus for producing the feed streams to the apparatus shown in FIG. 1.

Referring now to FIG. 2 of the drawings, a compressor 50 compresses a stream of air. The compressor 50 typically has associated therewith a water cooler (not shown) for removing heat of compression. The compressed air stream 50 is passed through a purification unit 52 effective to remove water vapour and carbon dioxide therefrom. The unit 52 employs beds (not shown) of adsorbent to effect this removal of water vapour and carbon dioxide. The beds are operated out of sequence with one another such that while one or more beds are purifying the feed air stream, the remainder are being regenerated, for example, by being purged with a stream of hot nitrogen. Such purification units and their operation are well known in the art and need not be described further. The purified air is divided into two streams. One stream passes through a heat exchanger 54 from its warm end 56 to its cold end 58 and forms the air stream that is introduced into the higher pressure column 8 through the inlet 2 (see FIG. 1).

Referring again to FIG. 2, a second stream of the purified air is further compressed in a booster-compressor 59 which has a water cooler (not shown) for removing the heat of compression associated therewith. The further compressed second air stream flows through the main heat exchanger 52 from its warm end 54 to an intermediate region thereof. The thus cooled second air stream is withdrawn from this region and is expanded in an expansion turbine 60 to the pressure of the low pressure rectification column 10 (see FIG. 1). This expanded air forms the stream that is introduced into the low pressure rectification column 10 through the inlet 4.

Referring again to FIG. 2, the expansion turbine 60 is coupled to the booster compressor 59 such that the work of expansion is employed to drive the compressor 59. The operation of the expansion turbine 60 also creates refrigeration which meets the two-fold requirements for refrigeration of the method described above with reference to FIG. 1. The first requirement is to compensate for heat absorbed from the surroundings of the apparatus. Such absorption of heat is kept to a minimum by confining all parts of the apparatus operating at below ambient temperature within a thermally insulating housing sometimes known in the art as a "cold box". Nonetheless, given that the columns 8, 10 and 22 all operate at cryogenic temperatures, such heat absorption cannot be eliminated. The second requirement for refrigeration is to provide that necessary for the production of liquid products. One of the main advantages offered by the method according to the invention is that by performing some of the oxygen production in the argon column 22, the reboil rate in the low pressure rectification column 10 may be improved. It becomes possible to introduce a greater proportion of the incoming air as low pressure air through the inlet 4 into the column 10. As a result, a greater proportion of the incoming air flows through the booster-compressor 59 and the expansion turbine 60. Thus, a number of advantages can be achieved. For example, the specific power is less than that of a comparable, conventional, plant. In addition, more refrigeration can be created and hence a greater proportion of the oxygen product can be collected in liquid state. Alternatively, a liquid nitrogen product may also be produced.

In order to provide cooling for the heat exchanger 54 shown in FIG. 2, passages 62 and 64 are provided through it from its cold end 58 to its warm end 56 for the flow of respectively gaseous oxygen and gaseous nitrogen product streams which may be taken from respectively the outlets 36 and 34 of the apparatus shown in FIG. 1.

Referring again to FIG. 1, it is to be appreciated that in flowing through the pressure reducing or throttling valve 44 the condensed argon-enriched liquid stream undergoes a drop in temperature which is related to the pressure drop thereacross. It is the size of this temperature difference which determines the amount of separation which can be performed in the section of the argon column 22 intermediate the level of the inlet 46 and the second condenser-reboiler 42 (which may be of the thermosiphon or downflow kind). In general, a pressure drop in the order of 0.3 bar is sufficient to provide the necessary temperature difference to produce pure oxygen. If a low pressure drop structured packing such as MELLAPAK is employed in the argon column 22 so as to effect liquid-vapour contact therein, the low pressure rectification column 10 may be operated at a conventional pressure of about 1.5 bar at the level of the outlet 40 for argon-enriched vapour while at the same time the pressure in the top of the argon column is maintained above atmospheric pressure.

There are also advantages to be obtained by virtue of the introduction of the argon-enriched fluid into the argon column 22 in liquid state. If the operation of the argon column 22 is plotted on a McCabe-Thiele diagram, the slope of the operating line is greater when the feed to the column 22 is introduced in the liquid rather than the vapour state. Accordingly, if there is a given number of theoretical plates from the level of the inlet 46 to the top of the column and if an argon product of given specification is produced, the requirement of the column 22 for liquid argon reflux is reduced by introducing the feed in liquid state. Moreover, since no liquid is returned from the bottom of the argon column 22 to an intermediate mass exchange level of the low pressure column 10 there is no return of argon therefrom to the low pressure column. Hence the rate of introduction of the argon-enriched Oxygen into the argon column 22 can be relatively low in comparison with a comparable conventional apparatus or plant. Both of the above factors enable the loading on the column to be reduced (in comparison with a comparable conventional plant) resulting in a smaller diameter column and a reduced load on the argon condenser 20. Hence the size of the condenser 20 can also be reduced.

Figure 4:
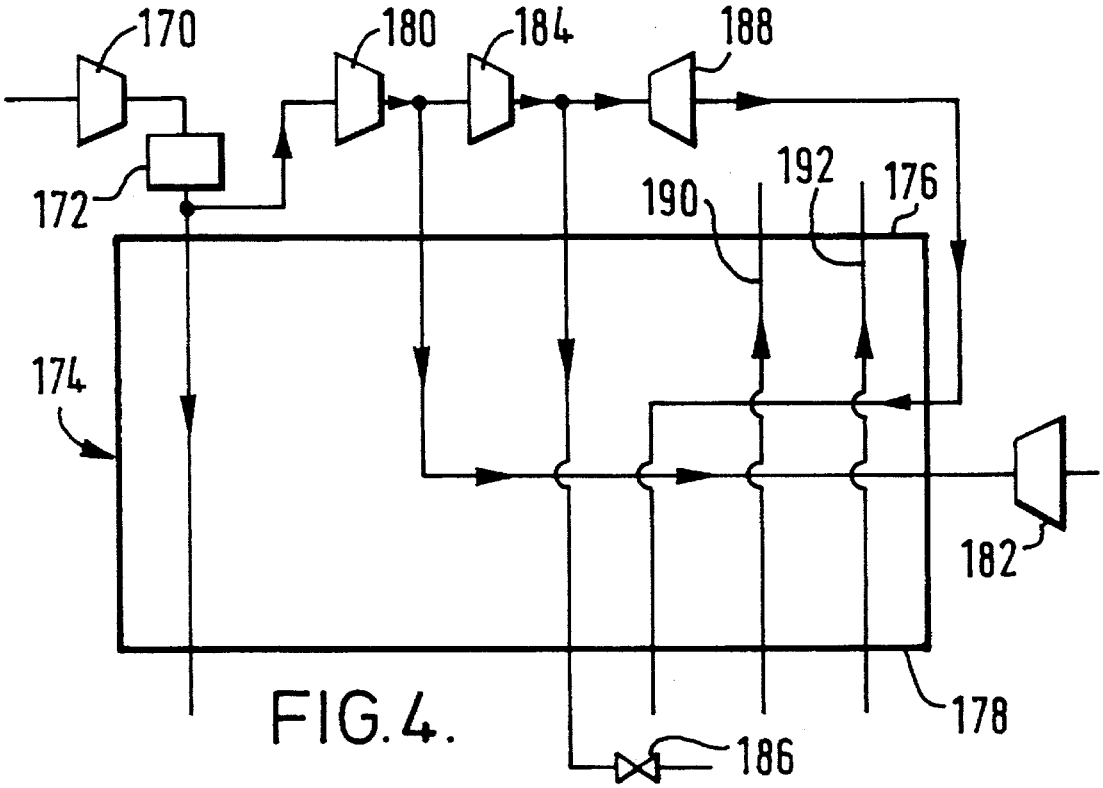
FIG. 4 is a schematic flow diagram of a heat exchanger and associated apparatus for producing the feed streams to the apparatus shown in FIG. 3.

Although, as described above, separation of an oxygen product in the argon column 22 enables more low pressure air to be processed in the lower pressure rectification column 10, the ability to maximize the advantage that can be obtained may be limited by a shortage of liquid nitrogen reflux in the lower pressure rectification column. Such a limitation may in particular arise if the double rectification column is required to handle a sizeable proportion of the incoming air in liquid state. Such a requirement can for example arise if a substantial proportion of the oxygen product is withdrawn from the column system in liquid state, is pressurized by means of a pump, and is vaporized to form an elevated pressure gaseous product. There is shown in FIGS. 3 and 4 of the accompanying drawings an apparatus which enhances the production of liquid nitrogen reflux for the low pressure rectification column 10 and thereby enables the method according to the invention to be operated in a so-called liquid pumping process.

Figure 3:
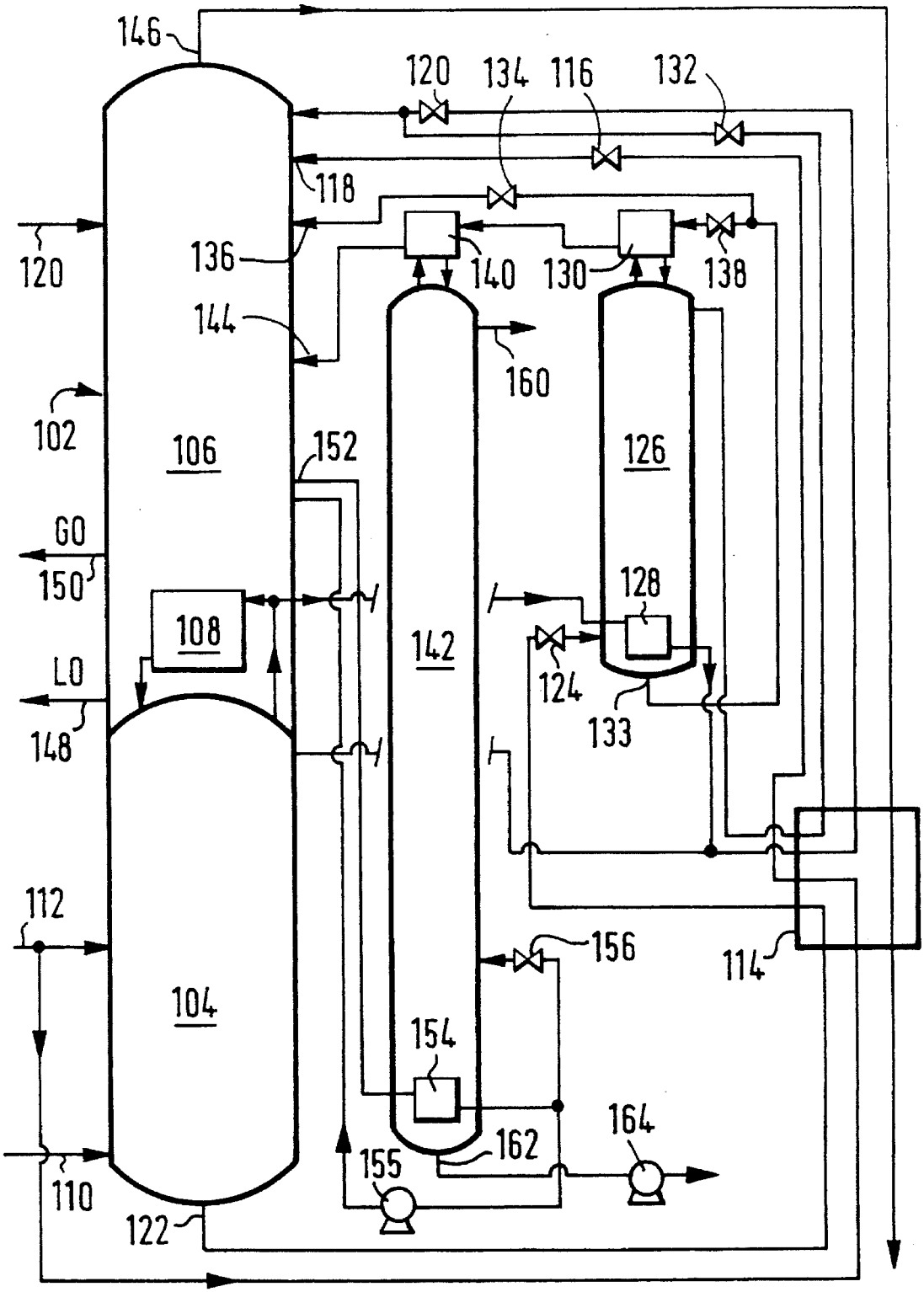
FIG. 3 is a schematic flow diagram of a second apparatus according to the invention.

Referring to FIG. 3 of the drawings, a double rectification column 102 comprises a higher pressure column 104 thermally linked to a low pressure rectification column 106 by a first condenser-reboiler 108. High pressure compressed gaseous air is introduced at its dew point or a temperature close thereto and typically at a pressure of about 6 bar into the bottom of the high pressure column 104 through an inlet 110. Liquid air is introduced into the higher pressure column 104 through a second inlet 112 at an intermediate mass-excange level therewithin. A portion of the liquid air is taken from upstream of the inlet 112, is sub-cooled in a heat exchanger 114, is reduced in pressure by passage through a throttling or pressure reduction valve 116, and is introduced into the low pressure rectification column 106 through an inlet 118 which is located at an intermediate mass transfer level thereof. Liquid-vapour contact devices (not shown)located in the low pressure rectification column 106 effect contact between the liquid phase and vapour phase and thus enable mass transfer to take place. (Such devices are also located, but not shown, in the higher pressure column 104.) The liquid-vapour contact devices in the columns 104 and 106 may comprise distillation trays or preferably, in the case of the lower pressure column 106, structured packing. As well as the inlet 118 for the liquid air, the low pressure rectification column 106 also has an inlet 120 for low pressure gaseous air.

The air that enters the higher pressure column 104 has nitrogen separated from it by virtue of countercurrent contact between ascending vapour and descending liquid reflux in the column 104. Liquid nitrogen reflux for the column 104 is formed by condensing nitrogen in the first condenser-reboiler 108 by indirect heat exchange with liquid oxygen separated in the low pressure rectification column 106, some of the liquid oxygen thereby being reboiled. A part of the liquid nitrogen condensate from the first condenser-reboiler 108 is employed as reflux in the higher pressure fractionation column 104. The remainder of the condensate is sub-cooled by passage through the heat exchanger 114 and is reduced in pressure by passage through a throttling valve 120. Downstream of the throttling valve 120, the liquid nitrogen condensate is introduced into the top of the low pressure rectification column 106 as reflux.

Unlike the apparatus shown in FIG. 1, the first condenser-reboiler 108 is not the sole source of liquid nitrogen reflux for the columns 104 and 106. A stream of oxygen-enriched liquid is withdrawn from the bottom of the higher pressure column 104 through an outlet 122, is sub-cooled in heat exchanger 114, and is passed through a pressure reduction valve 124 into a bottom region of an auxiliary (or intermediate pressure) rectification column 126 that operates at its top at a pressure (typically of about 3 bar) lower than the pressure at the top of the higher pressure column 104 but higher than that at the top of the low pressure column 106. The auxiliary rectification column 126 is provided at its bottom with a condenser-reboiler 128 (referred to herein as the "third condenser-reboiler") and this third condenser-reboiler 128 is employed to condense nitrogen vapour taken from the top of the higher pressure rectification column 104. The resulting liquid nitrogen reflux may be employed in one or both of the columns 104 and 106. In addition, the auxiliary rectification column 126 has a condenser 130 associated with it so as to condense nitrogen separated therein. Only a part of the liquid nitrogen is returned to the column 126 as reflux. The remainder is sub-cooled in the heat exchanger 114, is reduced in pressure by passage through a throttling valve 132 and is mixed with the liquid nitrogen stream that passes through the pressure reduction valve 120 at a region downstream of that valve 120.

Operation of the third condenser-reboiler 128 reboils part of the oxygen-enriched liquid that is collected in the bottom of the column 126. As a result, the liquid is further enriched in oxygen, while at the same time a vapour flow upwardly through the column 126 is created. The column 126 contains liquid-vapour contact devices (not shown) (e.g. distillation trays or packing) which enable mass transfer to take place between descending liquid and ascending vapour and as a result nitrogen is separated in the column 126. A stream of further-enriched liquid is withdrawn from the bottom of the auxiliary rectification column 126 through an outlet 133 and is divided into two separate streams. One of the streams of further-enriched liquid flows through a throttling valve 134 and is introduced into the low pressure rectification column 106 through an inlet 136 located at generally the same level as the inlet 120 but below the level of the inlet 118. The second stream of further enriched liquid is passed through a throttling valve 138 and is employed to cool the condenser 130 associated with the top of the auxiliary rectification column 126. As a result, a part only of the second further-enriched liquid stream is reboiled. The resulting vapour-liquid mixture flows out of the condenser 130 and is employed to cool another condenser 140 associated with the top of an argon column 142. More of the liquid content of the stream is thus vaporized and an essentially wholly vaporous stream, enriched in oxygen, flows from the condenser 140 into the low pressure rectification column 106 through an inlet 144.

The streams of air introduced into the low pressure rectification column 106 through the inlets 118 and 120 and the streams of oxygen-enriched fluid introduced therein through the inlets 136 and 144 are separated therein into oxygen and nitrogen. As previously mentioned, the flow of vapour upwardly through the column 106 is created by operation of the first condenser-reboiler 108 and flow of liquid nitrogen reflux is introduced into the column 106 at its top. The liquid-vapour contact devices (not shown) in the column 106 enable intimate contact between ascending vapour and descending liquid to take place and the resultant mass transfer causes the necessary separation to be performed. The gaseous nitrogen product is withdrawn through an outlet 146 at the top of the low pressure rectification column 106 and flows through the heat exchanger 114 from its cold end to its warm end. An oxygen product in liquid state is withdrawn from the bottom of the low pressure rectification column 106 through an outlet 148. If desired, an oxygen product in gaseous state may also be withdrawn through the outlet 150. Any oxygen withdrawn through the outlet 150 forms a low pressure product, whereas liquid oxygen withdrawn through the outlet 148 may be pressurized and converted into a high pressure oxygen product.

In a manner analogous to that described with respect to the low pressure rectification column 10 shown in FIG. 1, a local maximum argon concentration is created in the low pressure rectification column 106 shown in FIG. 3 at a level beneath the inlet 144. An argon-enriched stream typically containing at least 8% by volume of argon but having an argon concentration less than the maximum occurring in the column 106 is withdrawn in vapour state through an outlet 152 and is partially or preferably wholly condensed by passage through another condenser-reboiler 154 ("the second condenser-reboiler"). The condensation is effected by indirect heat exchange of the argon-enriched oxygen stream with liquid oxygen separated in the argon column 142, a part of the liquid oxygen being reboiled thereby. The resulting stream comprising condensate is divided into two parts. One part flows from the second condenser-reboiler 154 through a throttling valve 156 and is introduced into the argon column 142 at an intermediate mass exchange level thereof. The construction and operation of the argon column 142 are analogous to those of the argon column 22 shown in FIG. 1 of the accompanying drawings and described hereinabove. The other part of the condensate from the second condenser-reboiler 154 is returned by a pump 155 to substantially the same intermediate mass transfer level of the lower pressure column 106 as that of the outlet 152 from which the argon-enriched oxygen stream is taken for condensation. The condenser-reboiler 154 also therefore acts as an intermediate condenser for the low pressure column 106.

A stream of liquid argon product is withdrawn from the top of the argon column 142 through an outlet 160. A stream of liquid oxygen is withdrawn from the bottom of the argon column 142 through an outlet 162 by means of a pump 164 which raises the liquid oxygen to a supply pressure. The liquid oxygen withdrawn by the pump 164 may also include liquid oxygen from the outlet 148 of the low pressure rectification column 106. To this end, a conduit (not shown) having a throttling valve (not shown) disposed therein may extend from the outlet 148 into the bottom of the argon column 142.

Referring now to FIG. 4 of the accompanying drawings, an air stream is compressed in a first compressor 170. Downstream of the compressor 170 the air stream is passed through a purification unit 172 effective to remove water vapour and carbon dioxide therefrom. The unit 172 employs beds (not shown) of adsorbent to effect this removal of water vapour and carbon dioxide. The beds are operated out of sequence with one another such that while one or more beds are purifying the feed air stream, the remainder are being regenerated, for example, by being purged with a stream of hot nitrogen. Such purification units and their operation are well known in the art and need not be described further.

The purified air stream is divided into two subsidiary streams. A first subsidiary stream of purified air flows through a main heat exchanger 174 from its warm end 176 to its cold end 178 and is cooled to approximately its dew point thereby. The resulting cooled air forms a part of the high pressure air stream which is introduced into the higher pressure column 104 through the inlet 110 (see FIG. 3).

Referring again to FIG. 4, the second stream of purified compressed air is further compressed in a compressor 180. The further compressed air stream is divided into two parts. One part is cooled by passage through the main heat exchanger 174 from its warm end 176 to an intermediate region thereof and is withdrawn therefrom. This cooled further compressed stream of air is expanded with the performance of work in an expansion turbine 182 and forms the air which is introduced into the low pressure rectification column 106 through the inlet 120 (see FIG. 3).

Referring again to FIG. 4, the second stream of compressed air is compressed yet again in a compressor 184 and is divided into two subsidiary streams. One subsidiary stream flows from the compressor 184 through the main-heat exchanger 174 from its warm end 176 to its cold end 178. The resulting cooled, subsidiary stream of further compressed air is passed through a throttling valve 186 and the resultant liquid forms the liquid air which is divided between the inlet 110 to the higher pressure column 104 and the inlet 118 to the low pressure rectification column 106 (see FIG. 3). Referring again to FIG. 4, a second subsidiary stream of the yet further compressed air is expanded in a second expansion turbine 188. The resulting expanded air stream is introduced into the main heat exchanger 174 at an intermediate heat exchange region thereof and flows therefrom to its cold end 178. The resulting cold air stream forms the rest of the air stream which is introduced through the inlet 110 into the higher pressure column 104 (see FIG. 3). Referring again to FIG. 4, the product nitrogen stream is passed from the warm end of the heat exchanger 114 (see FIG. 3) through a passage 190 in the main heat exchanger 174 from its cold end 178 to its warm end 176. In addition a pressurized oxygen stream is passed by the pump 144 (see FIG. 3) through a passage 192 in the main heat exchanger 174 from its cold end 178 to its warm end 176. The oxygen is vaporized by its passage through the main heat exchanger 174. The outlet pressure of the compressor 184 is selected so as to maintain a close match between the temperature-enthalpy profile of the liquid oxygen stream being vaporized and that of the stream that flows out of the cold end 178 of the heat exchanger 174 into the throttling valve 186. In the above example, no gaseous oxygen is withdrawn from the low pressure rectification column 106 (see FIG. 3) through the outlet 150.

It will be appreciated that the greater the rate at which liquid oxygen is pumped through the heat exchanger 174 as shown in FIG. 4 and thus vaporized, the more air that is liquefied on passage through the throttling valve 186. Although it is possible to separate some liquid air in the low pressure rectification column 106, the amount that can be so separated is limited and increasing demands for high pressure oxygen product mean that the apparatus shown in FIG. 3 has to cope with a greater rate of introduction of liquid air into the high pressure rectification column 104. As a result, less nitrogen vapour tends to be provided at the top of the column 104 with a result that less liquid nitrogen reflux is formed in the first condenser-reboiler 108. However, analogously to the operation of the apparatus shown in FIG. 1, the condensation of the argon-enriched oxygen vapour stream and its downstream introduction into the argon column 142 makes possible an increase in the amount of low pressure air that can be fed directly into that column through the inlet 120. The introduction of air at an increased rate into the column 106 through the inlet 120 leads to an increased demand for liquid nitrogen reflux in the upper section of the low pressure rectification column 106. The operation of the intermediate pressure rectification column 126 enables the apparatus shown in FIG. 3 to meet this demand for increased reflux in the rectification column 106 even though the introduction of liquid air into the higher pressure column 104 through the inlet 112 actually reduces the ability of this column to produce liquid nitrogen for the lower pressure rectification column.

Various changes and modifications may be made to the apparatus shown in the accompanying drawings. For example, if the apparatus shown in FIG. 1 is required to separate a stream or streams of liquid air in addition to the gaseous air (for example, if such liquid air is formed by indirect heat exchange with a vaporizing, pressurized, liquid oxygen product) additional liquid nitrogen reflux for the columns 8 and 10 may be provided by liquefying a part of the gaseous nitrogen product withdrawn from the lower pressure rectification column 10 or from an external source of liquid nitrogen.

The intermediate pressure column 126 shown in FIG. 3 represents but one way of achieving this liquefaction. Additional changes that can be made to the apparatus as shown in FIG. 1 are that a liquid nitrogen product can be produced and that a high pressure gaseous nitrogen product can be withdrawn directly from the higher pressure rectification column 8. Changes to the ancillary apparatus shown in FIG. 2 may be made in order to meet changes to the requirements for refrigeration brought about in consequence of such modifications to the apparatus shown in FIG. 1.

In another modification, the condenser 20 associated with the top of the argon column 22 shown in FIG. 1 may be cooled by a liquid stream taken from an intermediate mass transfer region of the low pressure rectification column 10. The liquid stream is thereby at least partially vaporized and is returned to the low pressure rectification column 10.

The apparatus shown in FIG. 3 may be modified by reversing the direction of flow of the further-enriched liquid downstream of the valve 138. That is to say from the valve 138 the further-enriched liquid flows through the condenser 140 associated with the argon column 142, and, downstream of the condenser 140, flows through the condenser 130 associated with the intermediate pressure fractionation column 126. (Further, if desired, both the condensers 130 and 140 may be combined into a single heat exchanger.) From the condenser 130 the now vaporized further enriched oxygen stream flows through the inlet 144 into the lower pressure rectification column 106.

The term "pressure reducing valve" has been used herein to encompass the kind of valve often alternatively termed as "expansion valve" or a "throttling valve". A pressure reducing valve need have no moving parts and may simply comprise a length of pipe with a step between an inlet portion of smaller internal cross-sectional area and an outlet portion of larger internal cross-sectional area. As fluid flows over the step so it undergoes a reduction in pressure.

I claim:

1. A method of separating argon and oxygen products from oxygen-enriched air, comprising:

forming a stream of oxygen-enriched air at a temperature suitable for its separation by rectification;

separating the stream into oxygen and nitrogen in a low pressure rectification column;

supplying liquid nitrogen reflux to the low pressure rectification column;

creating a flow of reboiled oxygen upwardly through the low pressure rectification column;

withdrawing an argon-enriched oxygen vapour stream from an intermediate mass transfer region of the low pressure rectification column;

at least partially condensing the argon-enriched oxygen vapour stream;

reducing the pressure of at least part of the condensed argon-enriched stream;

introducing the resulting pressure-reduced stream into an intermediate mass exchange region of an argon column and separating argon-enriched and argon-depleted fluids therefrom;

the argon-enriched oxygen stream being condensed by indirect heat exchange with argon-depleted liquid separated in the argon column;

and returning another part of the condensed argon-enriched oxygen stream to the low pressure rectification column.

2. The method as claimed in claim 1, in which the part of the condensed argon-enriched oxygen stream that is returned to the low pressure rectification column is taken from upstream of where the said pressure reduction takes place.

3. The method as claimed in claim 1, wherein the stream of oxygen-enriched air is taken in liquid state from a higher pressure fractionation column in which nitrogen is separated from a stream of compressed air from which water vapour and carbon dioxide have been removed.

4. The method as claimed in claim 3, wherein nitrogen separated in the higher pressure rectification column is employed to reboil oxygen so as to create said flow of reboiled oxygen upwardly through the low pressure rectification column, the nitrogen thereby being condensed, and wherein the condensed nitrogen is a source of reflux for the higher pressure and lower pressure columns.

5. The method as claimed in claim 4, wherein the said condensation of the nitrogen provides only a part of the requirements of the low pressure and higher pressure columns for liquid nitrogen reflux.

6. The method as claimed in claim 3, wherein the stream of oxygen-enriched liquid air is further enriched in oxygen upstream of its being introduced into the low pressure column.

7. The method as claimed in claim 6, further comprising:

passing a stream of oxygen-enriched liquid air through a pressure reducing device into an intermediate pressure fractionation column operating at a pressure at its top higher than the pressure at the top of the higher pressure column; separating nitrogen from the oxygen-enriched liquid air in the intermediate pressure column; reboiling a part of a bottom liquid fraction formed in the intermediate pressure column to provide a flow of vapour upwardly therethrough; and withdrawing a stream of said bottom liquid fraction as the further-enriched liquid air.

8. The method as claimed in claim 7, wherein the reboiling of said bottom liquid fraction is performed by indirect heat exchange with nitrogen vapour separated in the higher pressure column.

9. The method as claimed in claim 8, wherein the argon column has a condenser at its top in which argon vapour separated in the argon column is condensed by indirect heat exchange with a stream of the further-enriched liquid air.

10. The method as claimed in claim 3, in which the argon column has a condenser at its top in which argon vapour separated in the argon column is condensed by indirect heat exchange with a stream of the oxygen-enriched liquid air from the higher pressure column.

11. The method as claimed in claim 1, further comprising withdrawing liquid oxygen product from the bottom of the argon column.

12. The method as claimed in claim 1, further comprising withdrawing liquid oxygen from the low pressure rectification column; reducing pressure of the liquid oxygen, introducing the liquid oxygen into a sump forming part of the argon column; withdrawing a single stream of liquid oxygen from the argon column; pressurizing the single stream of liquid oxygen; and vaporizing the single stream of liquid oxygen to form a gaseous oxygen product.

13. The method as claimed in claim 1, in which a stream of air is expanded in a turbine and introduced into the low pressure rectification column.

14. An apparatus for separating argon and oxygen products from oxygen-enriched air, comprising:

means for forming a stream of oxygen-enriched air at a temperature suitable for its separation by rectification;

a low pressure rectification column for separating the stream into oxygen and nitrogen;

a first condenser-reboiler for supplying liquid nitrogen reflux to the low pressure rectification column;

an argon column;

a conduit for the flow of an argon-enriched vapour stream from an intermediate mass transfer region of the low pressure rectification column to an intermediate mass transfer level of the argon column for separating argon-enriched and argon-depleted fluids from the argon-enriched vapour stream;

pressure reduction means in the conduit;

a second condenser-reboiler associated with the argon column;

the second-condenser reboiler having condensing passages positioned in the said conduit upstream of the said pressure reduction means so that at least a part of the argon-enriched vapour stream is condensed by indirect heat exchange with argon-depleted liquid separated in the argon column; and downstream of the condensing passages of the second condenser-reboiler, the said conduit communicating with an inlet to the low pressure rectification column.

15. The apparatus as claimed in claim 14, wherein the said conduit communicates upstream of the pressure reduction means with the said inlet to the low pressure rectification column.

16. The apparatus as claimed in claim 14, further comprising:

a higher pressure fractionation column for supplying the stream of oxygen-enriched air in liquid state to the low pressure rectification column, and nitrogen to the condensing passage of the first condenser-reboiler; a main heat exchanger; and means for removing water vapour and carbon dioxide from a stream of compressed air, the removal means having an outlet communicating via the main heat exchanger with an inlet for air to the higher pressure fractionation column.

17. The apparatus as claimed in claim 16, further comprising:

means for changing the composition of the oxygen-enriched liquid air intermediate the higher pressure and low pressure columns.

18. The apparatus as claimed in claim 17, further comprising:

said composition changing means comprising an intermediate pressure fractionating column for producing a bottom liquid fraction and a nitrogen-enriched vapour having an inlet communicating via a pressure-reducing device with an outlet from the higher pressure column; a third condenser-reboiler associated with the intermediate pressure column for reboiling some of the bottom liquid fraction and thereby for providing a flow of vapour upwardly through the intermediate pressure fractionation column; and means for conducting a stream of the bottom liquid fraction along a path that leads to the low pressure column as the further-enriched liquid.

19. The apparatus as claimed in claim 18, in which the intermediate pressure column has a condenser associated therewith which lies on said path.

20. The apparatus as claimed in claim 18, in which the argon column has a condenser associated therewith which lies on said path.

* * * * *